US008395558B2

(12) United States Patent
Alamouti et al.

(10) Patent No.: US 8,395,558 B2
(45) Date of Patent: Mar. 12, 2013

(54) MILLIMETER-WAVE REFLECTOR ANTENNA SYSTEM AND METHODS FOR COMMUNICATING USING MILLIMETER-WAVE SIGNALS

(75) Inventors: Siavash M. Alamouti, Hillsboro, OR (US); Alexander Alexandrovich Maltsev, Nizhny Novgorod (RU); Nikolay Vasilevich Chistyakov, Nizhny Novgorod (RU); Alexander Alexandrovich Maltsev, Jr., Nizhny Novgorod (RU); Vadim Sergeyevich Sergeyev, Novgorod (RU)

(73) Assignee: Intel Corporation, Santa Clara, CA (US)

( * ) Notice: Subject to any disclaimer, the term of this patent is extended or adjusted under 35 U.S.C. 154(b) by 629 days.

(21) Appl. No.: 12/301,669

(22) PCT Filed: Jun. 16, 2006

(86) PCT No.: PCT/RU2006/000316

§ 371 (c)(1),
(2), (4) Date: Mar. 19, 2009

(87) PCT Pub. No.: WO2007/136293

PCT Pub. Date: Nov. 29, 2007

(65) Prior Publication Data

US 2009/0219903 A1 Sep. 3, 2009

(30) Foreign Application Priority Data

May 23, 2006 (WO) ..... PCT/RU2006/000256

(51) Int. Cl.
*H01Q 19/06* (2006.01)

(52) U.S. Cl. ..... 343/754; 343/834; 343/840

(58) Field of Classification Search ..... 343/834, 343/840, 753–755; 342/368, 372
See application file for complete search history.

(56) References Cited

U.S. PATENT DOCUMENTS

| | | | | |
|---|---|---|---|---|
| 3,922,682 | A | 11/1975 | Hyde | |
| 4,224,626 | A | 9/1980 | Sternberg | |
| 4,321,604 | A | 3/1982 | Ajioka | |
| 5,206,658 | A * | 4/1993 | Wokurka | 343/755 |

(Continued)

FOREIGN PATENT DOCUMENTS

| | | |
|---|---|---|
| CN | 1331895 A | 1/2002 |
| DE | 03840451 | 6/1990 |

(Continued)

OTHER PUBLICATIONS

Fernandes, J., et al., "Impact of Shaped Lens antennas on MBS Systems", *Personal, indoor and Mobile Radio Communications*, 2(8), (Sep. 8, 1998), 744-748.

(Continued)

*Primary Examiner* — Hoang V Nguyen
(74) *Attorney, Agent, or Firm* — Schwegman, Lundberg, Woessner, P.A.

(57) ABSTRACT

Embodiments of millimeter-wave chip-array reflector antenna system are generally described herein. Other embodiments may be described and claimed. In some embodiments, the millimeter-wave chip-array reflector antenna system includes a millimeter-wave reflector to shape and reflect an incident antenna beam and a chip-array antenna comprising an array of antenna elements to direct the incident antenna beam at the surface of the reflector to provide a reflected antenna beam.

18 Claims, 7 Drawing Sheets

U.S. PATENT DOCUMENTS

| | | | | |
|---|---|---|---|---|
| 5,276,277 | A | 1/1994 | Hightower et al. | |
| 5,426,443 | A | 6/1995 | Jenness, Jr. | |
| 5,697,063 | A | 12/1997 | Kishigami et al. | |
| 6,018,659 | A | 1/2000 | Ayyagari et al. | |
| 6,320,538 | B1 | 11/2001 | Lalezari et al. | |
| 6,463,090 | B1 | 10/2002 | Dorfman | |
| 7,085,595 | B2 | 8/2006 | Kitchin | |
| 7,130,904 | B2 | 10/2006 | Kitchin | |
| 7,133,374 | B2 | 11/2006 | Lo et al. | |
| 7,190,324 | B2 | 3/2007 | Henderson | |
| 7,216,166 | B2 | 5/2007 | Sugauchi et al. | |
| 7,245,879 | B2 | 7/2007 | Sadri et al. | |
| 7,260,392 | B2 | 8/2007 | Kitchin | |
| 7,286,606 | B2 | 10/2007 | Maltsev et al. | |
| 7,324,605 | B2 | 1/2008 | Maltsev et al. | |
| 7,333,556 | B2 | 2/2008 | Maltsev et al. | |
| 7,336,716 | B2 | 2/2008 | Maltsev et al. | |
| 7,349,436 | B2 | 3/2008 | Maltsev et al. | |
| 7,352,696 | B2 | 4/2008 | Stephens et al. | |
| 7,366,471 | B1 | 4/2008 | Kitchin | |
| 7,948,428 | B2 * | 5/2011 | Lovberg et al. | 342/22 |
| 8,149,178 | B2 | 4/2012 | Alamouti et al. | |
| 2001/0026246 | A1 | 10/2001 | Burnside et al. | |
| 2002/0154656 | A1 | 10/2002 | Kitchin | |
| 2003/0228857 | A1 | 12/2003 | Maeki | |
| 2004/0003059 | A1 | 1/2004 | Kitchin | |
| 2004/0024871 | A1 | 2/2004 | Kitchin | |
| 2004/0061645 | A1 | 4/2004 | Seo et al. | |
| 2004/0100981 | A1 | 5/2004 | Kitchin | |
| 2004/0120301 | A1 | 6/2004 | Kitchin | |
| 2004/0120428 | A1 | 6/2004 | Maltsev et al. | |
| 2004/0127245 | A1 | 7/2004 | Sadri et al. | |
| 2004/0242275 | A1 | 12/2004 | Corbett et al. | |
| 2005/0031047 | A1 | 2/2005 | Maltsev et al. | |
| 2005/0032478 | A1 | 2/2005 | Stephens et al. | |
| 2005/0058057 | A1 | 3/2005 | Maltsev et al. | |
| 2005/0058095 | A1 | 3/2005 | Sadri et al. | |
| 2005/0068895 | A1 | 3/2005 | Stephens et al. | |
| 2005/0068900 | A1 | 3/2005 | Stephens et al. | |
| 2005/0135493 | A1 | 6/2005 | Maltsev et al. | |
| 2005/0140563 | A1 | 6/2005 | Eom et al. | |
| 2005/0141406 | A1 | 6/2005 | Maltsev et al. | |
| 2005/0141412 | A1 | 6/2005 | Sadri et al. | |
| 2005/0141657 | A1 | 6/2005 | Maltsev et al. | |
| 2005/0143125 | A1 | 6/2005 | Maltsev et al. | |
| 2005/0147076 | A1 | 7/2005 | Sadowsky et al. | |
| 2005/0152328 | A1 | 7/2005 | Sadri et al. | |
| 2005/0152466 | A1 | 7/2005 | Maltsev et al. | |
| 2005/0157638 | A1 | 7/2005 | Maltsev et al. | |
| 2005/0161753 | A1 | 7/2005 | Huff et al. | |
| 2005/0190800 | A1 | 9/2005 | Maltsev et al. | |
| 2005/0286544 | A1 | 12/2005 | Kitchin et al. | |
| 2005/0287978 | A1 | 12/2005 | Maltsev et al. | |
| 2006/0007898 | A1 | 1/2006 | Maltsev et al. | |
| 2006/0067426 | A1 | 3/2006 | Maltsev et al. | |
| 2006/0114816 | A1 | 6/2006 | Maltsev et al. | |
| 2007/0091988 | A1 | 4/2007 | Sadri et al. | |
| 2007/0097891 | A1 | 5/2007 | Kitchin | |
| 2007/0099668 | A1 | 5/2007 | Sadri et al. | |
| 2007/0099669 | A1 | 5/2007 | Sadri et al. | |
| 2007/0287384 | A1 | 12/2007 | Sadri et al. | |
| 2009/0315794 | A1 | 12/2009 | Alamouti et al. | |
| 2010/0033390 | A1 | 2/2010 | Alamouti et al. | |
| 2010/0156721 | A1 | 6/2010 | Alamouti et al. | |
| 2010/0214150 | A1 | 8/2010 | Lovberg et al. | |
| 2010/0231452 | A1 | 9/2010 | Babakhani et al. | |

FOREIGN PATENT DOCUMENTS

| | | | |
|---|---|---|---|
| EP | 0212963 | | 3/1987 |
| EP | 0212963 | A2 | 3/1987 |
| EP | 0548876 | A1 | 6/1993 |
| EP | 1077508 | A2 | 2/2001 |
| EP | 1085599 | A2 | 3/2001 |
| EP | 1650884 | A1 | 4/2006 |
| FR | 2569906 | | 3/1986 |
| JP | 6165605 | A | 4/1986 |
| JP | 06200584 | | 7/1994 |
| JP | 08-084107 | | 3/1996 |
| JP | 884107 | A | 3/1996 |
| JP | 8321799 | A | 12/1996 |
| JP | 09051293 | | 2/1997 |
| JP | 1155174 | A | 2/1999 |
| JP | 2000165959 | | 6/2000 |
| JP | 2000307494 | A | 11/2000 |
| JP | 2001308797 | | 11/2001 |
| JP | 2002534022 | | 10/2002 |
| JP | 2003124942 | A | 4/2003 |
| JP | 2005244362 | | 9/2005 |
| JP | 2006148928 | A | 6/2006 |
| KR | 20060029001 | | 4/2006 |
| WO | WO-9610277 | A1 | 4/1996 |
| WO | WO-0038452 | A1 | 1/2000 |
| WO | WO-0231908 | A2 | 4/2002 |
| WO | WO-2004114546 | A1 | 12/2004 |
| WO | WO-2005050776 | A2 | 6/2005 |
| WO | WO-2005114785 | A1 | 12/2005 |
| WO | WO-2007136289 | A1 | 11/2007 |
| WO | WO-2007136290 | A1 | 11/2007 |
| WO | WO-2007136292 | A1 | 11/2007 |
| WO | WO-2007136293 | A1 | 11/2007 |
| WO | WO-2007146733 | A1 | 12/2007 |

OTHER PUBLICATIONS

Ueda, T., et al., "An efficient MAC protocol with direction finding scheme in wireless ad hoc network using directional antenna", *IEEE Proceedings Radio and Wireless Conference*, 2003. RAWCON apos; 03., (2003), 233-236.

Ueda, Tetsuro, et al., "An Efficient MAC Protocol with Direction Finding Scheme in Wireless Ad Hoc Network using Directional Antenna", *Proceedings, Radio and Wireless Conference*, 2003., (Aug. 10-13, 2003), 4 pgs.

Wu, X., et al., "Design and Characterization of Single- and Multiple-Beam MM-Wave Circularly Polarized Substrate Lens Antennas for Wireless Communications", *IEEE Transactions on Microwave Theory and Techniques*, 49(3), (Mar. 2001), 2001-2003.

"U.S. Appl. No. 11/452,710, Final Office Action mailed Dec. 11, 2009", 20 pgs.

"Chinese Application Serial No. 200680054323.2, Office Action mailed Mar. 17, 2011", with English translation, 11 pgs.

"European Application No. 06824418.5, Response filed Feb. 8, 2010 to Office Action mailed Jul. 29, 2009", 2 pgs.

"European Application Serial No. 06824430.0, Response filed Feb. 8, 2010 to Office Action mailed Jul. 29, 2009", 2 pgs.

"European Application Serial No. 06835789.6, Office Action mailed Aug. 17, 2009", 2 pgs.

"Japanese Application Serial No. 2009-510911, Office Action mailed Feb. 1, 2011", with English translation, 8 pgs.

"U.S. Appl. No. 11/452,710, Non-Final Office Action mailed Aug. 19, 2010", 20 pgs.

"U.S. Appl. No. 11/452,710, Response filed Mar. 9, 2010 to Final Office Action mailed Dec. 11, 2009", 12 pgs.

"European Application No. 06824430.0, Office Action mailed Apr. 15, 2010", 5 pgs.

"European Application No. 06824417.7, Office Action mailed Aug. 14, 2009", 2 pgs.

"European Application No. 06824418.5, Office Action mailed Jul. 29, 2009", 5 pgs.

"European Application No. 06824430.0, Office Action mailed Aug. 24, 2009", 3 pgs.

Wu, Xidong, et al., "Design and characterization of single- and multiple-beam mm-wave circularly polarized substrate lens antennas for wireless communications", *IEEE Transactions on Microwave Theory and Techniques*, 49(3), (Mar. 2001), 431-441.

"U.S. Appl. No. 11/452,710, Response filed Nov. 22, 2011 to Non Final Office Action mailed Aug. 22, 2011", 15 pgs.

"U.S. Appl. No. 12/301,556, Notice of Allowance mailed Nov. 28, 2011", 8 pgs.

"European Application Serial No. 06824417.7, Response filed Jan. 12, 2010 to Office Action mailed Aug. 14, 2009", 13 pgs.

"European Application Serial No. 06824430.0, Response filed Mar. 3, 2010 to Office Action mailed Aug. 24, 2009", 17 pg.

"European Application Serial No. 06835789.6, Response filed Feb. 8, 2010 to Office Action mailed Aug. 17, 2009", 36 pgs.
"International Application Serial No. PCT/RU2006/000256, International Preliminary Report on Patentability mailed Dec. 11, 2008", 8 pgs.
"International Application Serial No. PCT/RU2006/000256, International Search Report and Written Opinion mailed Feb. 27, 2007", 13 pgs.
"International Application Serial No. PCT/RU2006/000257, International Preliminary Report on Patentability mailed Dec. 11, 2008", 10 pgs.
"International Application Serial No. PCT/RU2006/000257, International Search Report and Written Opinion mailed Jun. 18, 2007", 17 pgs.
"International Application Serial No. PCT/RU2006/000257, Partial International Search Report mailed Mar. 12, 2007", 5 pgs.
"International Application Serial No. PCT/RU2006/000315, International Preliminary Report on Patentability mailed Dec. 11, 2008", 7 pgs.
"International Application Serial No. PCT/RU2006/000315, International Search Report and Written Opinion mailed Mar. 7, 2007", 13 pgs.
"International Application Serial No. PCT/RU2006/000316, International Preliminary Report on Patentability mailed Dec. 11, 2008", 9 pgs.
"International Application Serial No. PCT/RU2006/000316, International Search Report and Written Opinion mailed Mar. 21, 2007", 13 pgs.
"International Application Serial No. PCT/US2007/070588, International Search Report and Written Opinion mailed Oct. 25, 2007", 10 pgs.
"U.S. Appl. No. 11/452,710, Non Final Office Action mailed Aug. 22, 2011", 21 pgs.
"U.S. Appl. No. 11/452,710, Response filed Jun. 1, 2011 to Advisory Action mailed May 6, 2011", 13 pgs.
"U.S. Appl. No. 12/301,556, Preliminary Amendment mailed Nov. 19, 2008", 3 pgs.
"U.S. Appl. No. 12/301,556, Response filed Oct. 28, 2011 to Restriction Requirement mailed Sep. 29, 2011", 8 pgs.
"U.S. Appl. No. 12/301,556, Restriction Requirement mailed Sep. 29, 2011", 7 pgs.
"U.S. Appl. No. 12/301,693, Non Final Office Action mailed Sep. 22, 2011", 10 pgs.
"U.S. Appl. No. 12/301,693, Preliminary Amendment filed Nov. 20, 2008", 3 pgs.
"U.S. Appl. No. 12/301,792, Preliminary Amendment filed Nov. 21, 2008", 3 pgs.
"Canadian Application Serial No. 200680054319.6, Office Action mailed Jun. 28, 2011", 14 pgs.
"Chinese Application Serial No. 200680054314.3, Office Action mailed Jul. 4, 2011", 5 pgs.
"Chinese Application Serial No. 200680054323.2, Response filed Sep. 26, 2011 to Office Action mailed Mar. 17, 2011", 22 pgs.
"Chinese Application Serial No. 200680054334.0, Office Action mailed Sep. 21, 2011", W/English Translation, 12 pgs.
"European Application Serial No. 06824430.0, Office Action mailed Apr. 28, 2011", 6 pgs.
"European Application Serial No. 06824430.0, Response filed Aug. 30, 2011 to Non Final Office Action dated Apr. 28, 2011", 3 pgs.
"Japanese Application No. 2009510911, Office Action mailed Jul. 5, 2011", with English translation, 2 pgs.
"Japanese Application Serial No. 2009-510911, Response filed May 2, 2011 to Non Final Office Action mailed Feb. 1, 2011", with English translation, 9 pgs.
"Japanese Application Serial No. 2009-515577, Office Action mailed May 31, 2011", with English translation, 6 pgs.
"Japanese Application Serial No. 2009-515577, Response filed Aug. 31, 2011 to Non Final Office Action dated May 31, 2011", 8 pgs.
"U.S. Appl. No. 11/452,710 , Response filed Mar. 23, 2012 to Non Final Office Action mailed Dec. 23, 2011", 15 pgs.
"U.S. Appl. No. 11/452,710, Non Final Office Action mailed Dec. 23, 2011", 16pgs.
"U.S. Appl. No. 11/452,710, Notice of Allowance mailed Apr. 13, 2012", 8 pgs.
"U.S. Appl. No. 12/301,556, Notice of Allowability mailed Dec. 8, 2011", 2 pgs.
"U.S. Appl. No. 12/301,603, Response filed Dec. 14, 2011 to Non Final Office Action mailed Sep. 22, 2011", 10 pgs.
"U.S. Appl. No. 12/301,693, Notice of Allowance mailed Feb. 7, 2012", 9 pgs.
"Chinese Application Serial No. 200680054314.3, Office Action Response filed Nov. 21, 2011", 14 pgs.
"Chinese Application Serial No. 200680054323.2, Office Action mailed Jan. 18, 2012", 13 pgs.
"Chinese Application Serial No. 200680054334.0, Office Action Response filed Jan. 17, 2012", 31 pgs.
"Chinese Application Serial No. 200780017307.0, Office Action mailed Dec. 31, 2011", 8 pgs.
"Chinese Application Serial No. 200680054319.6, Office Action Response filed Oct. 28, 2011", 12 pgs.
"Japanese Application Serial No. 2009-515577, Final Office Action mailed Jan. 31, 2012", w/ English Translation, 6 pgs.

* cited by examiner

MILLIMETER-WAVE COMMUNICATION SYSTEM

MILLIMETER-WAVE REFLECTOR ANTENNA SYSTEM AND METHODS FOR COMMUNICATING USING MILLIMETER-WAVE SIGNALS

This application is a U.S. National Stage Filing under 35 U.S.C. 371 from International Application No. PCT/RU2006/000316, filed Jun. 16, 2006 and published in English as WO 2007/136293 on Nov. 29, 2007, which application and publication are incorporated herein by reference in their entireties.

RELATED APPLICATIONS

This patent application relates to and claims priority to currently pending patent PCT application filed in the Russian receiving office on May 23, 2006 having application serial number PCT/RU2006/000256 .

This patent application relates to the currently pending patent PCT application filed in the Russian receiving office on May 23, 2006 having application Ser. No. PCTRU2006/000257, and to currently pending patent PCT application filed concurrently in the Russian receiving office having application Ser. No. PCT/RU2006/000315.

TECHNICAL FIELD

Some embodiments of the present invention pertain to wireless communication systems that use millimeter-wave signals. Some embodiments relate to millimeter-wave antenna systems that use reflectors.

BACKGROUND

Many conventional wireless networks communicate using microwave frequencies that generally range between two and ten gigahertz (GHz). These systems generally employ either omnidirectional or low-directivity antennas primarily because of the comparatively long wavelengths of the microwave frequencies. The low directivity of these antennas may limit the throughput of such systems. Directional antennas could improve the throughput of these systems, but the wavelength of microwave frequencies make compact directional antennas difficult to implement. The millimeter-wave band may have available spectrum and may be capable of providing higher throughput levels. Furthermore, directional antennas may be smaller and more compact at millimeter-wave frequencies.

Thus, there are general needs for compact directional millimeter-wave antennas and antenna systems suitable for use in wireless communication networks. There are also general needs for compact directional millimeter-wave antennas and antenna systems that may improve the throughput of wireless networks.

DETAILED DESCRIPTION

The following description and the drawings sufficiently illustrate specific embodiments of the invention to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for, those of other embodiments. Embodiments of the invention set forth in the claims encompass all available equivalents of those claims. Embodiments of the invention may be referred to herein, individually or collectively, by the term "invention" merely for convenience and without intending to limit the scope of this application to any single invention or inventive concept if more than one is in fact disclosed.

Figure 1A:
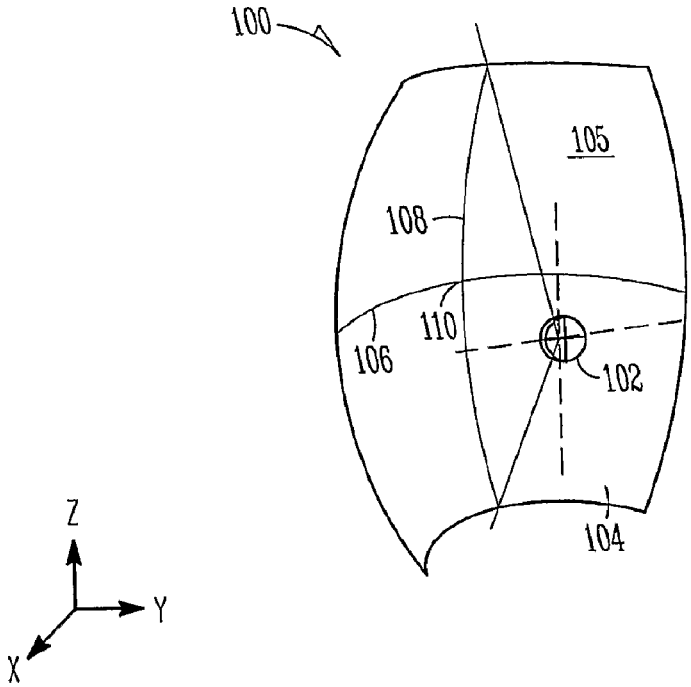
FIGS. 1A and 1B illustrate millimeter-wave chip-array reflector antenna systems in accordance with some embodiments of the present invention.
Figure 1B:
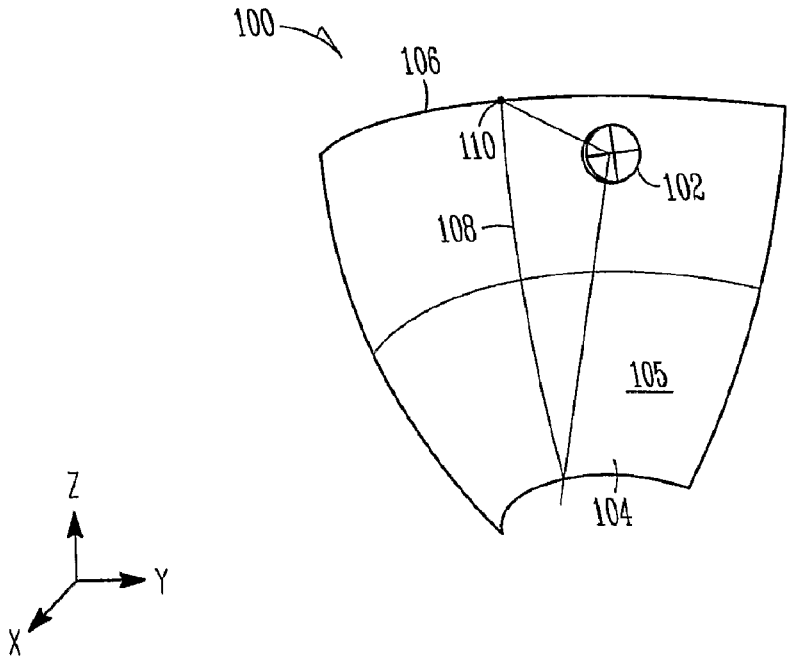

FIGS. 1A and 1B illustrate millimeter-wave chip-array reflector antenna systems in accordance with some embodiments of the present invention. Millimeter-wave chip-array reflector antenna system 100 includes millimeter-wave reflector 104 and chip-array antenna 102. Chip-array antenna 102 generates and directs an incident antenna beam at surface 105 of millimeter-wave reflector 104 to provide a steerable antenna beam over a plurality of beam-steering angles in azimuth and/or elevation. Millimeter-wave reflector 104 reflects and shapes the incident antenna beam to generate a reflected beam that may have a predetermined directivity pattern in azimuth and elevation. The curvature of millimeter-wave reflector 104 may be selected so that the steerable antenna beam is highly directional in azimuth and/or elevation. These embodiments are discussed in more detail below. In some embodiments, chip-array antenna 102 may be positioned at or near a focus of millimeter-wave reflector 104, although the scope of the invention is not limited in this respect.

In some embodiments, chip-array antenna 102 comprises an array of antenna elements. In these embodiments, the amplitude and/or phase of the antenna elements may be controlled to direct an incident antenna beam at reflector 104 to provide a steerable antenna beam over the plurality of beam-scanning angles. These embodiments are discussed in more detail below.

In some embodiments, surface 105 of millimeter-wave reflector 104 may be defined by substantially circular arc 106 in a first plane and substantially parabolic arc 108 in a second plane to provide a steerable antenna beam that is diverging in azimuth and substantially non-diverging in elevation, although the scope of the invention is not limited in this respect. In these embodiments, the steerable antenna beam may be fan-shaped in azimuth and may be more needle-shaped in elevation. In some embodiments, the first plane may be a horizontal plane and the second plane may be a vertical plane, although the scope of the invention is not limited in this respect as the terms horizontal and vertical may be interchanged. These embodiments are also discussed in more detail below.

In some embodiments (illustrated in FIG. 1A), reflector 104 may be substantially symmetrical with respect to substantially parabolic arc 108. In these embodiments, vertex 110 of substantially parabolic arc 108 may be located at or near a center of reflector 104, although the scope of the invention is not limited in this respect. In these embodiments, substantially parabolic arc 108 is symmetrical with respect to vertex 110.

In some other embodiments (illustrated in FIG. 1B), reflector 104 may be non-symmetrical with respect to substantially parabolic arc 108. In these embodiments, vertex 110 of substantially parabolic arc 108 is not located near the center of reflector 104. In these embodiments, substantially parabolic arc 108 is also symmetrical with respect to vertex 110 however the lower half of substantially parabolic arc 108 defines reflector 104 making reflector 104 non-symmetrical. Among other things, the use of a non-symmetric reflector may help reduce shadowing that might occur in receive mode due to chip-array antenna 102 blocking received signals that would otherwise be directly incident on reflector 104. The use of a non-symmetric reflector may also help reduce feedback illumination on chip-array antenna 102 that may occur in transmit mode causing unfavorable excitation. These embodiments are also described in more detail below.

In some embodiments, air may fill the spacing between millimeter-wave reflector 104 and chip-array antenna 102. In some other embodiments, millimeter-wave refractive material may fill the spacing between millimeter-wave reflector 104 and chip-array antenna 102. In these embodiments, the millimeter-wave refractive material may include a cross-linked polymer, such as Rexolite, although other polymers and dielectric materials, such as polyethylene, poly-4-methylpentene-1, Teflon, and high density polyethylene, may also be used. Rexolite, for example, may be available from C-LEC Plastics, Inc., Beverly, N.J., USA. In some embodiments, gallium-arsenide (GaAs), quartz, and/or acrylic glass may be used for the millimeter-wave refractive material.

In some embodiments, surface 105 may be defined in a first plane to provide a steerable antenna beam having a diverging directivity pattern in azimuth. In these embodiments, millimeter-wave reflector 104 may be further defined in a second plane to provide a steerable antenna beam with a substantially secant-squared ($sec^2$) directivity pattern in elevation. In these embodiments, the substantially secant-squared pattern in elevation may provide one or more user devices with approximately the same antenna gain and/or sensitivity for transmission and/or reception of signals substantially independent of the distance from antenna system 100 at least over a predetermined range, although the scope of the invention is not limited in this respect. In some embodiments, the substantially secant-squared directivity pattern may be a squared cosecant directivity pattern.

In some embodiments, chip-array antenna 102 may be located at or near a focus of substantially parabolic arc 108. The location of chip-array antenna 102 with respect to the focus of the substantially parabolic arc 108 may be selected to reduce sidelobes of the steerable antenna beam, although the scope of the invention is not limited in this respect. In some embodiments, substantially parabolic arc 108 may be a vertical generatrix of surface 105. In some embodiments, surface 105 may comprise a section of a torroidal-paraboloidal surface which may be obtained by the revolution of a parabola around an axis parallel to the z-axis illustrated in FIG. 1A.

In some alternate embodiments, surface 105 may be defined by a substantially circular arc 106 of a parabolic arc in the first plane and an elliptical arc in the second plane to provide a steerable antenna beam having a diverging directivity pattern in azimuth and a substantially non-diverging directivity pattern in elevation. In these embodiments, the vertical generatrix of reflector 104 may be elliptical with the main axis of the ellipse lying in x-y plane (e.g., horizontal) and the auxiliary axis of the ellipse parallel to z-axis. In these embodiments, reflector 104 may have a shape obtained by revolving a vertical elliptical generatrix around an axis parallel to z-axis. In some embodiments, the revolving axis may contain one of the focuses of the ellipse, although the scope of the invention is not limited in this respect.

Reflector 104 and chip-array antenna 102 may be mechanically coupled in various ways. In some embodiments, reflector 104 and chip-array antenna 102 may be coupled by a single rod or mechanical link. In these embodiments, one end of the rod may be attached to chip-array antenna 102, and the other end of the rod may be attached to an edge of reflector 104 or to a point on surface 105. In some embodiments, the rod may support chip-array antenna 102 and may carry the weight of chip-array antenna 102, although the scope of the invention is not limited in this respect. In some embodiments, the rod may be hollow and cables/wires may be provided inside the rod to electrically couple chip-array antenna 102 with system circuitry, which may be located behind reflector 104. In some other embodiments, reflector 104 and chip-array antenna 102 may be coupled using several rods to support chip-array antenna 102 with increased rigidity. In these embodiments, reflector 104 may be a symmetrical reflector, although the scope of the invention is not limited in this respect. In some other embodiments, system circuitry may be enclosed in a case and reflector 104 may be attached to an edge of the case. Chip-array antenna 102 may be secured on or near the surface of the case. In these embodiments, the case may provide mechanical support to both reflector 104 and chip-array antenna 102. Cables/wires may run from chip-array antenna 102 into the case. In these embodiments, reflector 104 may be a non-symmetrical reflector, although the scope of the invention is not limited in this respect.

In some embodiments, millimeter-wave chip-array reflector antenna system 100, including additional signal processing circuitry and/or transceiver circuitry, may be mounted on a ceiling or a wall of a room for indoor applications, or mounted on walls, poles or towers for outdoor applications. Examples of these embodiments are discussed in more detail below.

Figure 2:
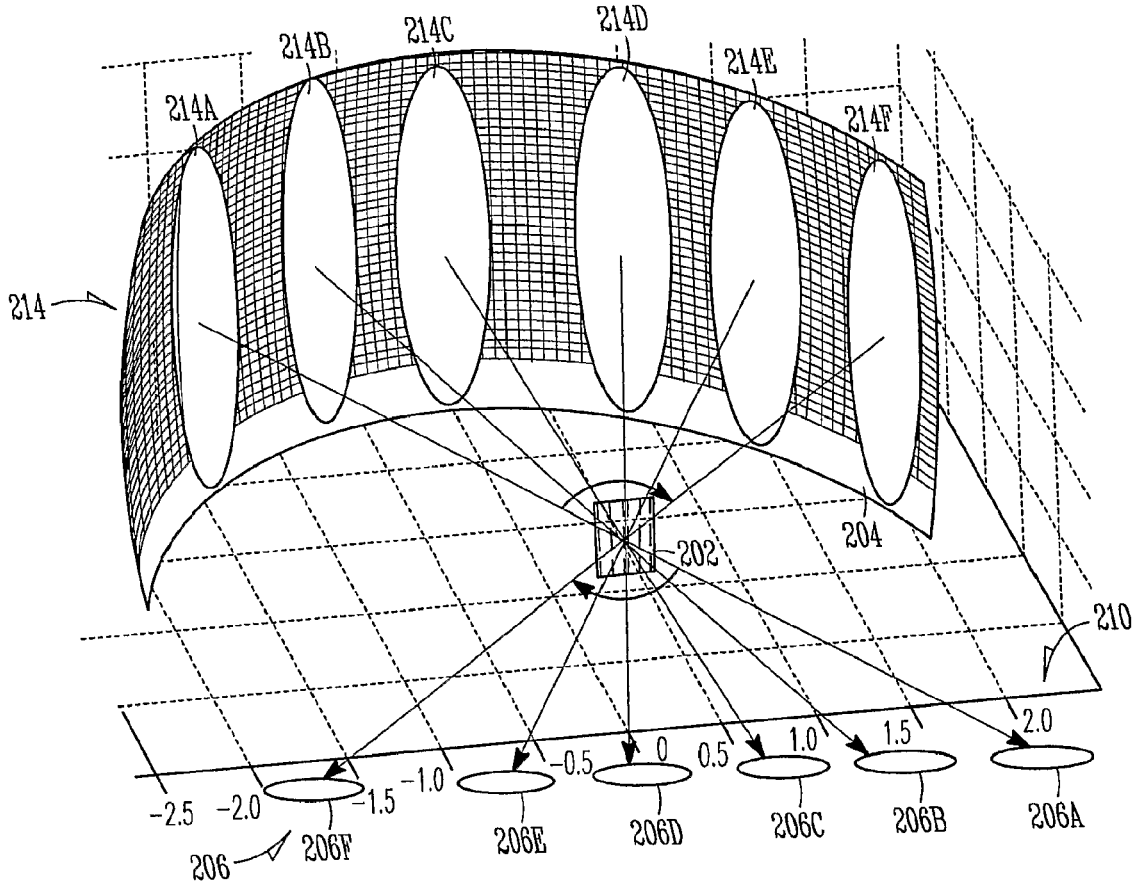
FIG. 2 illustrates beam-scanning angles of a millimeter-wave chip-array reflector antenna system in accordance with some embodiments of the present invention.

FIG. 2 illustrates beam-scanning angles of a millimeter-wave chip-array reflector antenna system in accordance with some embodiments of the present invention. In FIG. 2, chip-array antenna 202 may correspond to chip-array antenna 102 (FIGS. 1A and 1B), and reflector 204 may correspond to reflector 104 (FIGS. 1A and 1B). Chip-array antenna 202 directs incident antenna beam 214 at reflector 204 to provide steerable reflected antenna beam 206 over a plurality of azimuth scanning angles 210. In these embodiments, chip-array antenna 202 may illuminate a portion of the surface of reflector 204 with an incident antenna beam. For example, during beam-scanning, chip-array antenna 202 may direct incident antenna beam 214A at reflector 204 to provide reflected antenna beam 206A, chip-array antenna 202 may direct incident antenna beam 214B at reflector 204 to provide reflected antenna beam 206B, chip-array antenna 202 may direct incident antenna beam 214C at reflector 204 to provide reflected antenna beam 206C, chip-array antenna 202 may direct incident antenna beam 214D at reflector 204 to provide reflected antenna beam 206D, chip-array antenna 202 may direct incident antenna beam 214E at reflector 204 to provide reflected antenna beam 206E, and chip-array antenna 202 may direct incident antenna beam 214F at reflector 204 to provide reflected antenna beam 206F. Although incident antenna beam 214A through 214F and antenna beams 206A through 206F are illustrated as separate discrete beams, in some embodiments, chip-array antenna 202 may sweep incident antenna beam 214 across the surface of reflector 204 to provide steerable reflected antenna beam 206 over azimuth scanning angles 210.

Although FIG. 2 illustrates beam-scanning using a symmetrical reflector (e.g., reflector 204), embodiments of the present invention are also applicable to beam-scanning using non-symmetrical reflectors, such as reflector 104 (FIG. 1B). The use of non-symmetrical reflectors may help reduce or even eliminate shadowing that may be caused by chip-array antenna 202.

In some embodiments, the shape of reflector 204 may allow chip-array antenna 202 to scan in azimuth with a relatively wide incident antenna beam, while concurrently, reflector 204 may 'squeeze' the incident antenna beam in elevation to provide an overall higher gain. In the embodiments illustrated in FIG. 2, the portions of reflector 204 illuminated by incident antenna beams 214A through 214F may be larger in elevation and smaller in azimuth due to the directivity pattern of chip-array antenna 202. These embodiments may provide reflected antenna beam 206 which may be narrower in elevation and wider in azimuth.

In those embodiments in which reflector 204 is defined by a substantially circular arc 106 (FIG. 1), the beamwidth of incident antenna beam 214 provided by chip-array antenna 202 does not change substantially in azimuth when reflected by reflector 204. On the other hand, in those embodiments in which reflector 204 is defined by a substantially parabolic arc 108 (FIG. 1), incident antenna beam 214 may be narrowed in accordance with the vertical size of the area illuminated. These embodiments are described in more detail below.

Figure 3A:
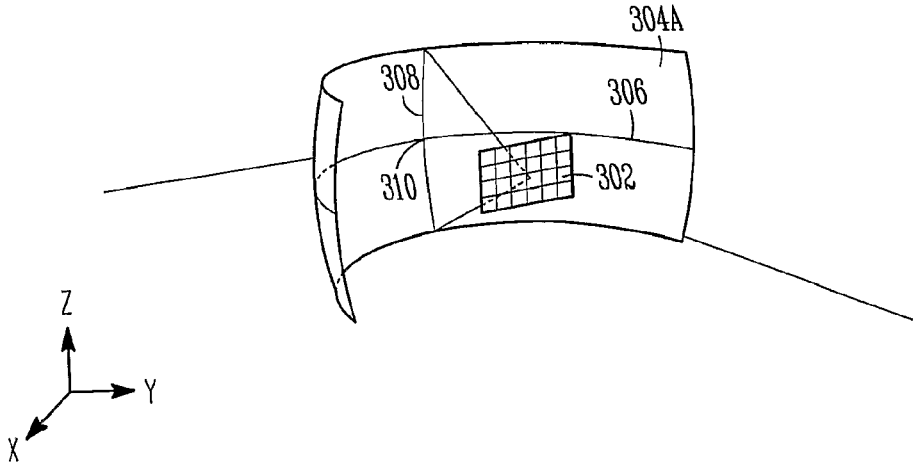
FIGS. 3A, 3B, 3C and 3D illustrate millimeter-wave chip-array reflector antenna systems in accordance with some embodiments of the present invention.
Figure 3B:
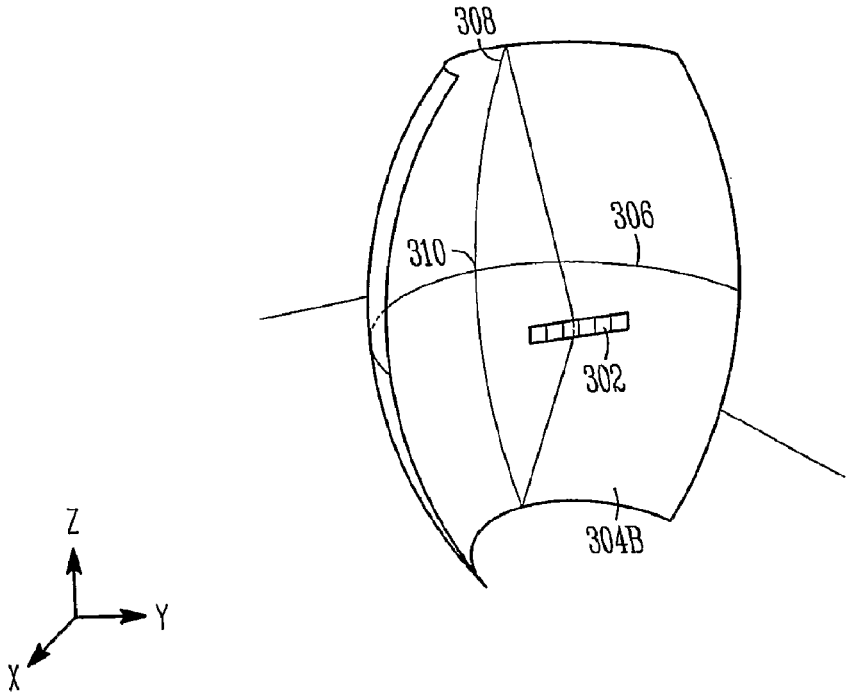
Figure 3C:
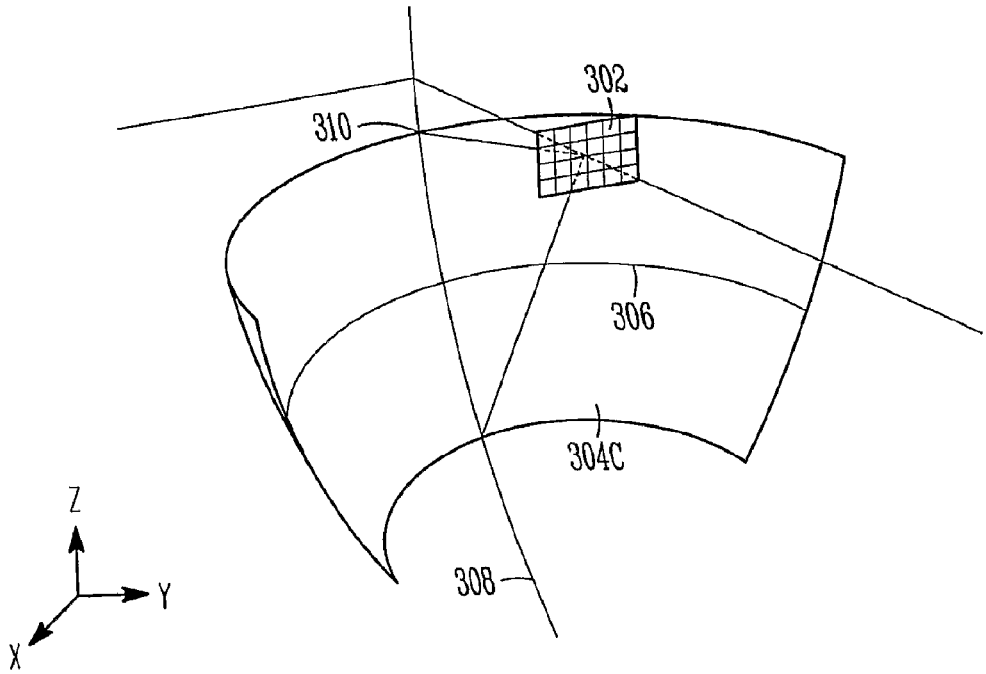
Figure 3D:
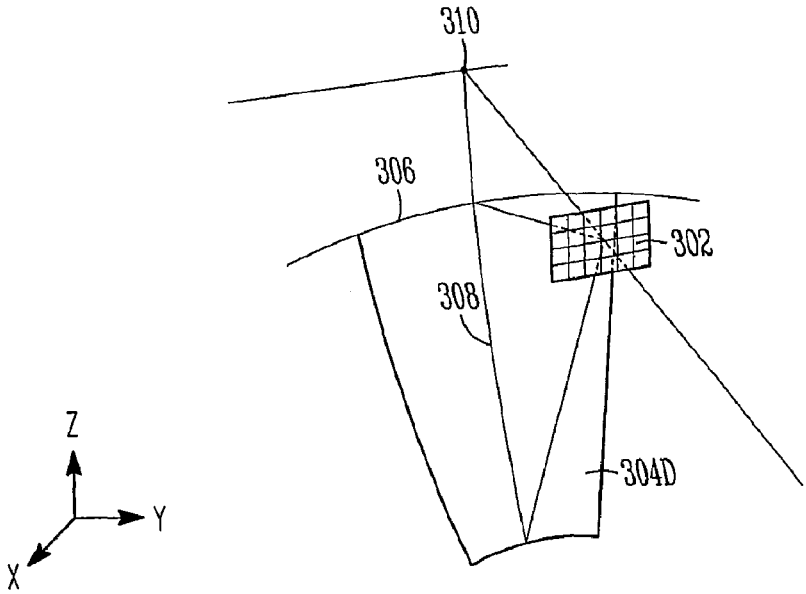

FIGS. 3A, 3B, 3C and 3D illustrate millimeter-wave chip-array reflector antenna systems in accordance with some embodiments of the present invention. In FIGS. 3A, 3B, 3C and 3D, chip-array antenna 302 may correspond to chip-array antenna 102 (FIGS. 1A and 1B), and reflectors 304A, 304B, 304C and 304D may correspond to reflector 104 (FIGS. 1A and 1B). FIGS. 3A and 3B illustrate reflectors 304A and 304B that may be substantially symmetric with respect to substantially parabolic arcs 308, while FIGS. 3C and 3D illustrate reflectors 304C and 304D that are non-symmetric with respect to substantially parabolic arcs 308. Reflectors 304A, 304B, 304C and 304D are illustrated as being further defined by arcs 306, which may be substantially circular. The reflector and chip configuration may be chosen depending on the system requirements, such as whether the system is designed for indoor or outdoor use and the range and coverage area of the system. In FIGS. 3A, 3B, 3C and 3D, each of substantially parabolic arcs 308 may have vertex 310.

FIG. 3A illustrates reflector 304A that may be suitable for applications where a wide azimuth scanning angle (e.g., up to 150-160 degrees) may be desired. In these embodiments, the gain of the antenna may be reduced to achieve a smaller vertical size of reflector 304A. In these embodiments, reflector 304A may be wider along the x-axis and shorter along the z-axis as illustrated. In these embodiments, chip-array antenna 302 may provide a relatively narrow incident antenna beam in the x-y plane (e.g., the vertical plane) to direct most or all of its emissions onto reflector 304A to achieve greater efficiency. In these embodiments, chip-array antenna 302 may be relatively larger along the z-axis, although the scope of the invention is not limited in this respect.

FIG. 3B illustrates reflector 304B that has a greater vertical size to help generate antenna beams having a smaller beamwidth in elevation. In these embodiments, chip-array antenna 302 may be relatively narrow along the z-axis to provide a wider beam in x-z plane to better illuminate the z-dimension of reflector 304B. In these embodiments, chip-array antenna 302 may be a linear antenna array oriented along the x-axis, although the scope of the invention is not limited in this respect. In these embodiments, the reflected antenna beams with a smaller beamwidth generated by reflector 304B may be narrow, needle-shaped and/or substantially non-diverging in elevation.

FIGS. 3C and 3D illustrate non-symmetric reflectors 304C and 304D. Reflector 304C is larger along the x-axis and may provide a greater scanning angle in azimuth than reflector 304D. Reflector 304D, on the other hand, may be used when a larger scanning angle is not required and/or for smaller size applications, although the scope of the invention is not limited in this respect.

In the symmetric embodiments of FIGS. 3A and 3B, vertex 310 of parabolic arcs 308 may be located at or near the center of reflectors 304A and 304B. In the non-symmetric embodiments of FIGS. 3C and 3D, vertex 310 may be located away from the center of reflectors 304C and 304D. In some non-symmetric embodiments, vertex 310 may be located off the surface of reflector 304D as illustrated.

Figure 4A:
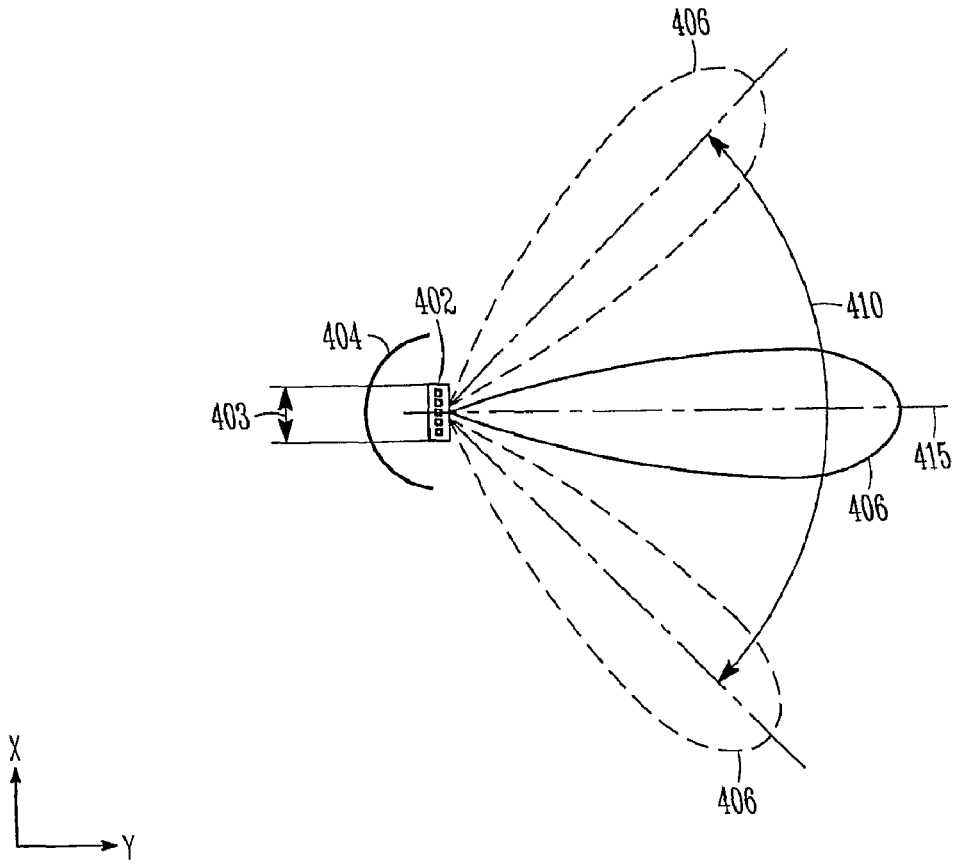
FIG. 4A illustrates azimuth scanning angles and azimuth directivity patterns of a millimeter-wave chip-array reflector antenna system in accordance with some embodiments of the present invention.
Figure 4B:
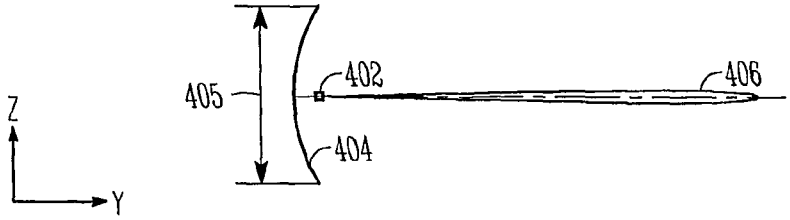
FIG. 4B illustrates elevation directivity patterns of a millimeter-wave chip-array reflector antenna system in accordance with some embodiments of the present invention.
Figure 4C:
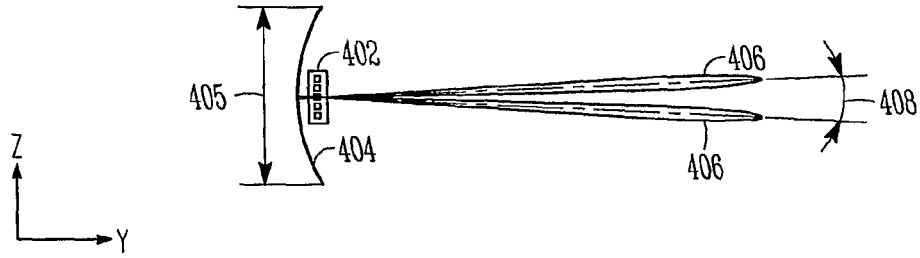
FIG. 4C illustrates elevation scanning angles and elevation directivity patterns of a millimeter-wave chip-array reflector antenna system in accordance with some embodiments of the present invention.

FIG. 4A illustrates azimuth scanning angles and azimuth directivity patterns of a millimeter-wave chip-array reflector antenna system in accordance with some embodiments of the present invention. FIG. 4B illustrates elevation directivity patterns of a millimeter-wave chip-array reflector antenna system in accordance with some embodiments of the present invention. FIG. 4C illustrates elevation scanning angles and elevation directivity patterns of a millimeter-wave chip-array reflector antenna system in accordance with some embodiments of the present invention. In FIGS. 4A, 4B and 4C, chip-array antenna 402 may correspond to chip-array antenna 102 (FIGS. 1A and 1B), and reflector 404 may correspond to reflector 104 (FIGS. 1A and 1B). In some embodiments, FIG. 4A may illustrate a top view, while FIGS. 4B and 4C may illustrate side views, however the terms 'top' and 'side' may be interchanged without affecting the scope of the invention.

As illustrated in FIG. 4A, reflected antenna beam 406 may be steerable over azimuth scanning angle 410. In this example, reflected antenna beam 406 may have a directivity pattern in azimuth that is fan-shaped (e.g., wide and diverging). In these embodiments, chip-array antenna 402 may have multiple antenna elements along the x-axis and reflector 404 may have a substantially circular horizontal cross-section to provide azimuth scanning over azimuth scanning angle 410. In some embodiments, azimuth scanning angle 410 provided by reflector 304A (FIG. 3A), reflector 304B (FIG. 3B) and/or reflector 304C (FIG. 3C) may range up to 160 degrees or more, although the scope of the invention is not limited in this respect. In these embodiments, when reflector 404 is defined by a circular arc in one plane and when chip-array antenna 402 is located at or near the center of the circular arc, the beamwidth in azimuth may be determined by chip-array aperture size 403 in the x-y plane.

In some embodiments, chip-array antenna 402 may comprise a five element array of half-wavelength spaced linear antenna elements. In these embodiments, the array may be oriented in the x-y plane and the beamwidth of reflected antenna beam 406 may be about 25 degrees (i.e., at the −3 dB level) in azimuth, for example. In some other embodiments, chip-array antenna 402 may comprise an eight element antenna array of half-wavelength spaced linear antenna elements. In these embodiments, the array may be oriented in the x-y plane and the beamwidth of reflected antenna beam 406 may be about 15 degrees in azimuth, for example. In some embodiments, the beamwidth in azimuth may at least in part depend on the azimuth angle of the incident antenna beam provided by chip-array antenna 402. For example when the incident antenna beam is steered at an azimuth angle of 60 degrees, the beamwidth may be about two times the beamwidth provided by the same antenna system at azimuth of zero degrees. In these embodiments, the azimuth angle may be calculated with respect to direction 415. In these embodiments, azimuth scanning angle 410 may range from −60 degrees to +60 degrees, although the scope of the invention is not limited in this respect.

As illustrated in FIG. 4B, reflected antenna beam 406 may be narrow (e.g., substantially non-diverging or needle-shaped) in elevation. In some of these embodiments, chip-array antenna 402 may have a single row of antenna elements and the array may be oriented perpendicular to the y-z plane (i.e., in the x-direction). In these embodiments, the directivity pattern of an incident antenna beam in elevation may be determined by the directivity pattern of each antenna element. In these embodiments, chip-array antenna 402 may generate a relatively wide incident antenna beam in the y-z plane to illuminate a substantial part of reflector 404 in the y-z plane. In these embodiments, vertical aperture 405 may be significantly greater than the aperture of each antenna element of chip-array antenna 402 in the vertical plane.

In some embodiments, for increased efficiency, the illuminated area of reflector 404 may be about equal the height of reflector 404. In these embodiments, when reflector 404 is defined by substantially parabolic cross-section in the y-z plane, the directivity pattern in elevation is determined by the vertical size of reflector 404, which may result in reflected antenna beam 406 being substantially narrow in elevation as illustrated in FIG. 4B. In some embodiments, the size of vertical aperture 405 may be about 25 cm and the wavelength of the millimeter-wave signals may be about 5 mm (i.e., at about 60 GHz). In these embodiments, the beamwidth of reflected antenna beam 406 may be about one degree in elevation. In some embodiments, up to a 34 dB gain may be achieved using chip-array antenna 402 with a linear array of five antenna elements. In some other embodiments, up to a 36 dB gain may be achieved using chip-array antenna 402 with a linear array of eight antenna elements, although the scope of the invention is not limited in this respect.

As illustrated in FIG. 4C, reflected antenna beam 406 may be steerable over elevation scanning angle 408. In these embodiments, chip-array antenna 402 may comprise a planar array of antenna elements having several rows of antenna elements along the z-axis. These embodiments may provide for elevation scanning within elevation scanning angle 408. In these embodiments when reflector 404 is defined by a substantially parabolic arc in the z-direction, elevation scanning angle 408 may be relatively small and may be at least partially determined by the ratio of the size of vertical aperture 405 to the focal distance to reflector 404, although the scope of the invention is not limited in this respect.

In some embodiments, elevation scanning angle 408 may be on the order of two to three beamwidths in the y-z plane. Greater elevation scanning angles may be achieved by increasing the size of chip-array antenna 402 in the z-direction (i.e., by adding more rows of antenna elements). In some embodiments, vertical aperture 405 may be about 25 cm and elevation scanning angle 408 may be about two to three degrees. In these embodiments, the focal distance of reflector 404 may be about 180 mm, and elevation scanning angle 408 of about two to three degrees may be achieved by row-by-row switching of the antenna elements of chip-array antenna 402. In these embodiments, chip-array antenna 402 may have five elements in the z-dimension, although the scope of the invention is not limited in this respect. In some other embodiments, elevation scanning angle 408 may be as great as five degrees, which may be achieved with chip-array antenna 402 having eight antenna elements in z-dimension, although the scope of the invention is not limited in this respect.

In the example illustrated in FIG. 4B, only a single antenna element is illustrated in the z-direction, which may be suitable for some embodiments that do not perform scanning in elevation. On the other hand in FIG. 4C, a plurality of antenna elements is illustrated in the z-direction to achieve scanning over elevation angle 408.

Figure 5A:
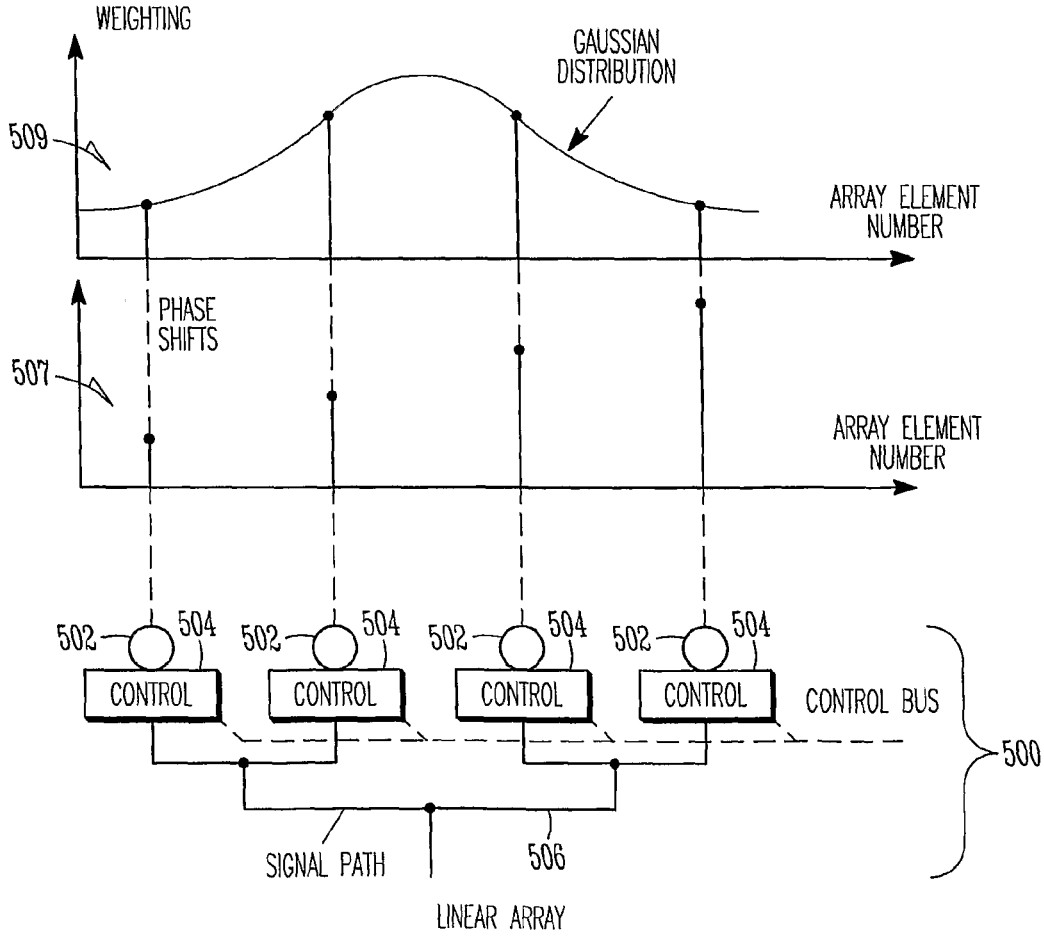
FIG. 5A illustrates a chip-array antenna with a linear array of antenna elements in accordance with some embodiments of the present invention.
Figure 5B:
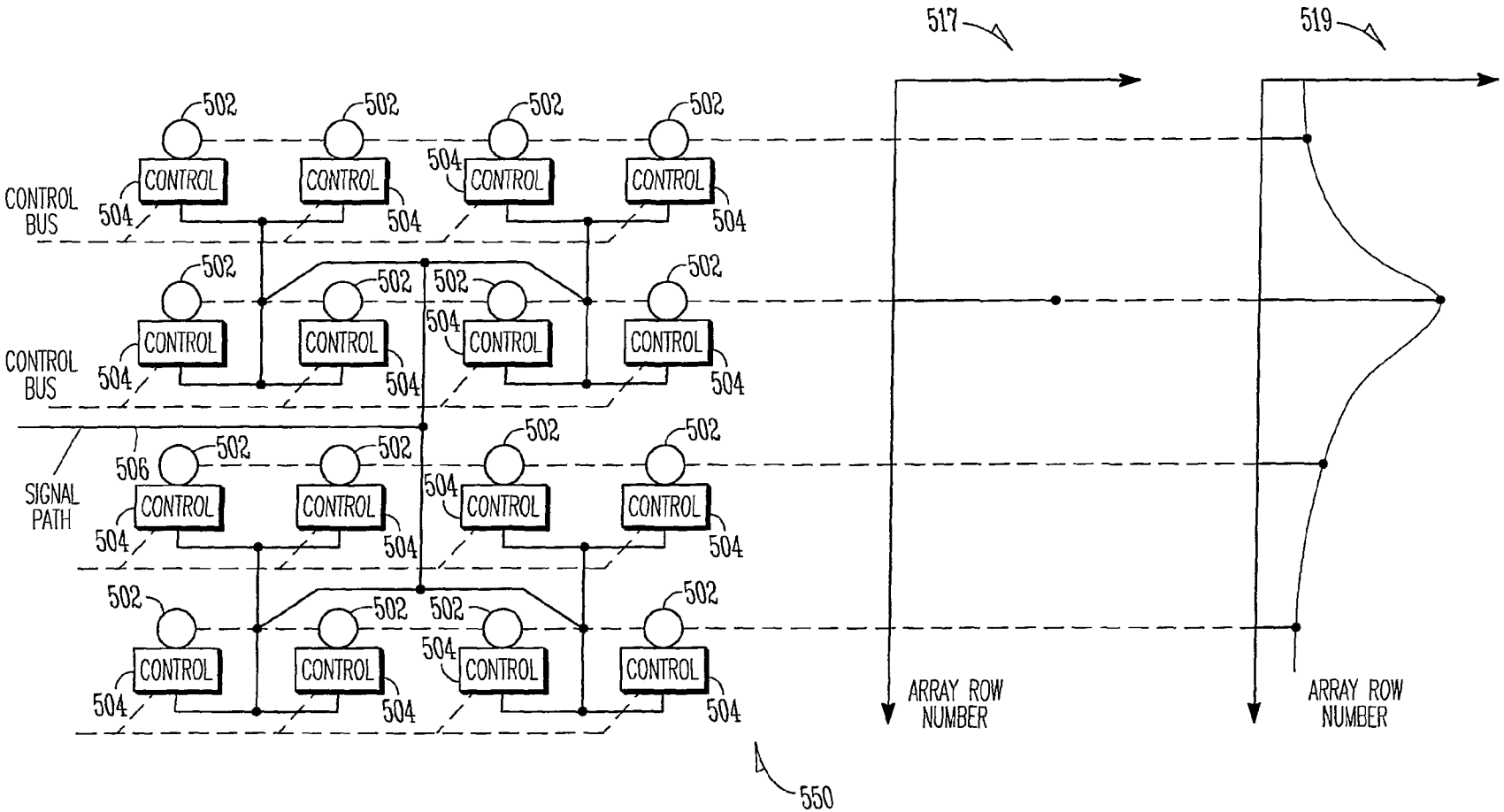
FIG. 5B illustrates a chip-array antenna with a planar array of antenna elements in accordance with some embodiments of the present invention.

FIG. 5A illustrates a chip-array antenna with a linear array of antenna elements in accordance with some embodiments of the present invention. In FIG. 5A, chip-array antenna 500 may be suitable for use as chip-array antenna 102 (FIGS. 1A and 1B). FIG. 5B illustrates a chip-array antenna with a planar array of antenna elements in accordance with some embodiments of the present invention. In FIG. 5B, chip-array antenna 550 may be suitable for use as chip-array antenna 102 (FIGS. 1A and 1B). Chip-array antennas 500 and 550 may comprise a plurality of antenna elements 502 coupled to millimeter-wave signal path 506 through control elements 504.

In FIG. 5A, control elements 504 may provide phase shifts 507 and amplitude weightings 509 for each antenna element 502 of the linear array as illustrated. To implement azimuth scanning, control elements 504 may shift the phase of signals by a value proportional to the indices of antenna elements 502 in the array. In some embodiments, to reduce side-lobes in azimuth, control elements 504 may weight the amplitudes and/or phases in accordance with a weighting function. In some embodiments, control elements 504 may implement a Gaussian or cosine weighting distribution, although the scope of the invention is not limited in this respect.

In FIG. 5B, control elements 504 may provide amplitude weightings, such as amplitude weightings 517 or 519, for each row of antenna elements 502. In these embodiments, one dimension of antenna elements 502 may be oriented along an x-axis and may implement beam-scanning in azimuth. In these embodiments, the other dimension of antenna elements 502 may be oriented along the z-axis and may implement beam-scanning in elevation. In some embodiments, control elements 504 may switch on and off rows of antenna elements 502 to provide a desired elevation angle using amplitude weightings, such as amplitude weightings 517. In this case of amplitude weightings 517, the elevation angle of the steerable antenna beam may be varied discretely. In other embodiments, control elements 504 may apply weighting coefficients, such as amplitude weightings 519, to the rows of antenna elements 502 in accordance with a weighting function to provide smooth elevation scanning. Amplitude weightings 519 illustrate an example of a smooth weighting function that may allow reflected antenna beam 406 (FIG.

4C) to be smoothly scanned (e.g., swept) in elevation over elevation scanning angle 408, although the scope of the invention is not limited in this respect.

Although FIGS. 5A and 5B illustrate that antenna elements 502 are fed in parallel, the scope of the invention is not limited in this respect. In other embodiments, antenna elements 502 may be fed in a serial manner and/or a combined serial and parallel manner. In some embodiments, beam steering circuitry may provide the appropriate control signals to control elements 504 to provide amplitude weightings and phase shifts.

Referring to FIGS. 1-5, in some embodiments, control elements 504 may turn on and off rows of antenna elements 502 to change the elevation angle of reflected antenna beam 406. In these embodiments, control elements 504 may further change an amplitude and a phase shift between antenna elements 502 of each row to scan incident antenna beam 214 over surface 105 of reflector 104 to steer reflected antenna beam 406 over azimuth scanning angle 410. In these embodiments, the planar array of antenna elements 502 may be a substantially flat two dimensional array as illustrated in FIG. 5B, although the scope of the invention is not limited in this respect.

In some embodiments, the amplitudes and phases within rows of antenna elements in FIG. 5B may be controlled similarly to the way the row of antenna elements 502 is controlled in FIG. 5A. In these embodiments, the amplitudes of antenna elements 502 in FIG. 5B may correspond to the product of the amplitude distributions in the x and z-dimensions of the array, and the phase shifts may correspond to the sum of the phase distributions in the x and z-dimensions of the array, although the scope of the invention is not limited in this respect.

In some embodiments, the planar array of antenna elements 502 in FIG. 5B may be viewed as having rows and columns of antenna elements 502. In some of these embodiments, control elements 504 may control the phase shift between antenna elements 502 in each row in accordance with an arithmetic progression. In these embodiments, control elements 504 may further control the phase of antenna elements 502 of each column to be substantially uniform. In these embodiments, control elements 504 further control the amplitude of most or all antenna elements 502 of the planar array to be substantially uniform to achieve a predetermined minimum beamwidth of the steerable antenna beam. Control elements 504 may further sweep a phase difference between antenna elements 502 of the rows to scan an incident antenna beam over surface 105 of reflector 104. In these embodiments, beam-scanning may be achieved by changing a phase difference between elements in each row of antenna elements 502 while maintaining a fixed phase difference between antenna elements 502 of each column, although the scope of the invention is not limited in this respect.

In some embodiments, groups of antenna elements 502 may be selected (i.e., turned on) by control elements 504 to change a position of an incident antenna beam on reflector 104 to provide the plurality of beam-scanning angles. In these embodiments, different numbers of antenna elements 502 may be selected (i.e., turned on) to control a beamwidth of the steerable antenna beam. In some embodiments, control elements 504 may also weight the amplitude and provide a phase distribution to each of antenna elements 502 to control the main lobe, the side lobes, and the position and the shape of the steerable antenna beam, although the scope of the invention is not limited in this respect.

In some embodiments, antenna elements 502 and control elements 504 may be fabricated directly on a semiconductor die. In some embodiments, each antenna element 502 and an associated one of control elements 504 may be fabricated close together to reduce some of the connection issues associated with millimeter-wave frequencies. In some embodiments, antenna elements 502 may be fabricated on a high-resistive poly-silicon substrate. In these embodiments, an adhesive wafer bonding technique and through-wafer electrical vias may be used for on-chip integration, although the scope of the invention is not limited in this respect. In some other embodiments, a quartz substrate may be used for monolithic integration. In some other embodiments, chip-array antenna 102 may be fabricated using a semiconductor fabrication process, such as a complementary metal oxide semiconductor (CMOS) process, a silicon-geranium (SiGe) process or a gallium arsenide (GaAs) process, although other semiconductor fabrication processes may also be suitable.

In some embodiments, chip-array antennas 500 and/or 550 may comprise a wafer with antenna elements 502 fabricated thereon and a semiconductor die with control elements 504 fabricated thereon. In these embodiments, the die may be bonded to the wafer and antenna elements 502 may be connected to control elements 504 with vias, although the scope of the invention is not limited in this respect.

In some other embodiments, antenna elements 502 may be fabricated on a dielectric substrate and control elements 504 may be fabricated on a semiconductor die. In these embodiments, the die may be bonded to a dielectric substrate and antenna elements 502 may be connected to control elements 504 using vias or bridges. In these embodiments, unnecessary die material may be removed by etching.

In some other embodiments, antenna elements 502 may be fabricated on a ceramic substrate, such as a low temperature co-fired ceramic (LTCC), and control elements 504 may be fabricated on a semiconductor die. In these embodiments, the semiconductor die may be connected to antenna elements 502 using a flip-chip connection technique, although the scope of the invention is not limited in this respect. In some of these embodiments, the front end of a millimeter-wave transceiver may be implemented as part of the semiconductor die. In these embodiments, the transceiver as well as antenna elements 502 and control elements 504 may be fabricated as part of an LTCC module, although the scope of the invention is not limited in this respect.

In some embodiments, antenna elements 502 may comprise dipole elements, although other types of antenna elements, such as bow-ties, monopoles, patches, radiating slots, quasi-Yagi antennas, and/or inverted-F antennas may also be used, although the scope of the invention is not limited in this respect. Although some embodiments of the present invention describe millimeter-wave chip-array reflector antenna system 100 with respect to transmitting signals, some embodiments are equally applicable to the reception of signals. In some embodiments, the same antenna elements may be used for receiving and transmitting, while in other embodiments, a different set of antenna elements may be used for transmitting and for receiving. In embodiments that use the same antenna elements for both receiving and transmitting, transmit-receive switching elements may be used to connect the antenna elements. In some embodiments, the transmit-receive switching elements may comprise field effect transistors (FETs) and/or PIN diodes. In some embodiments, transmit-receive switching elements may be fabricated on the same substrate or die as antenna elements 502, although the scope of the invention is not limited in this respect.

In some embodiments, different transmit and receive frequencies may be used. In these embodiments, a duplex filter (e.g., a duplexer) may be used instead of the transmit-receive switching elements. In these embodiments, the duplex filter may separate the transmit and receive frequencies. In some embodiments, the duplex filter may be a ceramic filter and may be relatively large. In these embodiments, the duplex filter may be fabricated separately from the substrate or die, although the scope of the invention is not limited in this respect.

Figure 6:
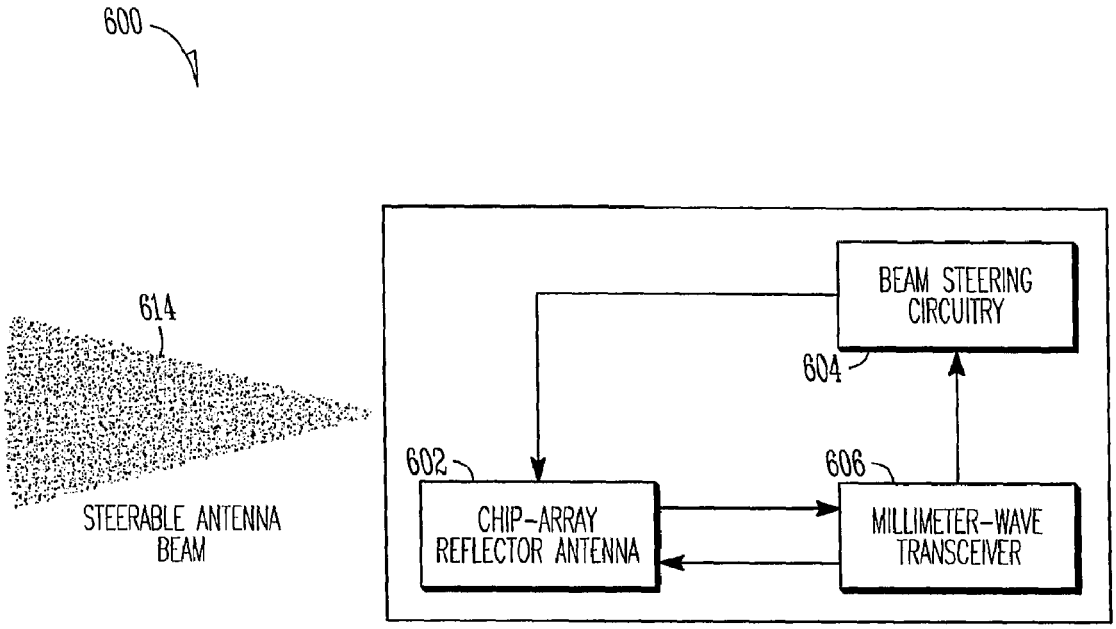
FIG. 6 illustrates a millimeter-wave communication system in accordance with some embodiments of the present invention.

FIG. 6 illustrates a millimeter-wave communication system in accordance with some embodiments of the present invention. Millimeter-wave communication system 600 may include chip-array reflector antenna 602, millimeter-wave transceiver 606 and beam-steering circuitry 604. Chip-array reflector antenna 602 may correspond to chip-array antenna system 100 (FIGS. 1A and 1B) and may include reflector 104 (FIGS. 1A and 1B) and chip-array antenna 102 (FIGS. 1A and 1B).

In these embodiments, chip-array reflector antenna 602 may receive millimeter-wave communication signals from one or more user devices and provide the received signals to millimeter-wave transceiver 606 for processing. Millimeter-wave transceiver 606 may also generate millimeter-wave signals for transmission by chip-array reflector antenna 602 to one or more user devices. Beam steering circuitry 604 may provide control signals to steer steerable antenna beam 614 generated by chip-array reflector antenna 602 for receiving and/or transmitting. In some embodiments, beam steering circuitry 604 may provide control signals for control elements 504 (FIGS. 5A and 5B). In some embodiments, beam steering circuitry 604 may be part of transceiver 606, although the scope of the invention is not limited in this respect.

Although millimeter-wave communication system 600 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein. In some embodiments, the functional elements of millimeter-wave communication system 600 may refer to one or more processes operating on one or more processing elements.

In some embodiments, millimeter-wave communication system 600 may be part of a communication station, such as wireless local area network (WLAN) communication station including a Wireless Fidelity (WiFi) communication station, an access point (AP) or a mobile station (MS) that communicates using millimeter-wave communication signals. In some embodiments, millimeter-wave communication station 600 may communicate using multicarrier signals, such as orthogonal frequency division multiplexed (OFDM) signals, comprising a plurality of subcarriers at millimeter-wave frequencies. In some embodiments, millimeter-wave communication system 600 may be mounted on a ceiling or a wall of a room for indoor applications or mounted on a wall, a pole or a tower for outdoor applications.

In some other embodiments, millimeter-wave communication system 600 may be part of a broadband wireless access (BWA) network communication station, such as a Worldwide Interoperability for Microwave Access (WiMax) communication station that communicates using millimeter-wave communication signals, although the scope of the invention is not limited in this respect as millimeter-wave communication system 600 may be part of almost any wireless communication station. In some embodiments, millimeter-wave communication system 600 may communicate using a multiple access technique, such as orthogonal frequency division multiple access (OFDMA). In these embodiments, millimeter-wave communication system 600 may communicate using millimeter-wave signals comprising a plurality of subcarriers at millimeter-wave frequencies.

In some other embodiments, millimeter-wave communication system 600 may be part of a wireless communication device that may communicate using spread-spectrum signals, although the scope of the invention is not limited in this respect. In some alternate embodiments, single carrier signals may be used. In some of these embodiments, single carrier signals with frequency domain equalization (SC-FDE) using a cyclic extension guard interval may also be used, although the scope of the invention is not limited in this respect.

As used herein, the terms 'beamwidth' and 'antenna beam' may refer to regions for either reception and/or transmission of millimeter-wave signals. Likewise, the terms 'generate' and 'direct' may refer to either the reception and/or transmission of millimeter-wave signals. As used herein, user devices may be a portable wireless communication device, such as a personal digital assistant (PDA), a laptop or portable computer with wireless communication capability, a web tablet, a wireless telephone, a wireless headset, a pager, an instant messaging device, a digital camera, an access point, a television, a medical device (e.g., a heart rate monitor, a blood pressure monitor, etc.), or other device that may receive and/or transmit information wirelessly. In some embodiments, user devices may include a directional antenna to receive and/or transmit millimeter-wave signals.

In some embodiments, millimeter-wave communication system 600 may communicate millimeter-wave signals in accordance with specific communication standards or proposed specifications, such as the Institute of Electrical and Electronics Engineers (IEEE) standards including the IEEE 802.15 standards and proposed specifications for millimeter-wave communications (e.g., the IEEE 802.15 task group 3c 'Call For Intent' (CFI) dated December 2005), although the scope of the invention is not limited in this respect as they may also be suitable to transmit and/or receive communications in accordance with other techniques and standards. For more information with respect to the IEEE 802.15 standards, please refer to "IEEE Standards for Information Technology—Telecommunications and Information Exchange between Systems"—Part 15.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus, the following claims are hereby incorporated into the detailed description, with each claim standing on its own as a separate preferred embodiment.

What is claimed is:

1. An integrated millimeter-wave chip-array reflector antenna system comprising:

a millimeter-wave reflector to shape and reflect an incident antenna beam; and a chip-array antenna comprising an array of antenna elements to generate and scan the incident antenna beam over a surface of the reflector to provide a steerable antenna beam over a beam-scanning angle;

wherein the array of antenna elements is fabricated on either a ceramic substrate or a resistive poly-silicon dielectric substrate and the control elements are fabricated on a semiconductor die, and wherein the semiconductor die is integrated with either the ceramic or the poly-silicon dielectric substrate.

2. The millimeter-wave chip-array reflector antenna system of claim 1 wherein the surface is defined by a substantially circular arc in a first plane and a substantially parabolic arc in a second plane to provide the steerable antenna beam having a diverging directivity pattern in azimuth and a substantially non-diverging directivity pattern in elevation.

3. The millimeter-wave chip-array reflector antenna system of claim 2 wherein the reflector is non-symmetrical with respect to the substantially parabolic arc, and wherein a vertex of the substantially parabolic arc is located off of the surface of the reflector.

4. The millimeter-wave chip-array reflector antenna system of claim 2 wherein the chip-array antenna is located at or near a focus of the substantially parabolic arc, the substantially parabolic arc being a generatrix of the surface, and wherein a location of the chip-array antenna with respect to the focus of the substantially parabolic arc is selected to reduce sidelobes of the steerable antenna beam.

5. The millimeter-wave chip-array reflector antenna system of claim 1 wherein the surface is defined by a substantially circular arc in a first plane to provide the steerable antenna beam having a diverging directivity pattern in azimuth, and wherein the millimeter-wave reflector is further defined in a second plane to provide the steerable antenna beam having a substantially secant-squared directivity pattern in elevation.

6. The millimeter-wave chip-array reflector antenna system of claim 1 wherein the surface is defined by a substantially circular arc in a first plane and an elliptical arc in a second plane to provide the steerable antenna beam having a diverging directivity pattern in azimuth and a substantially non-diverging directivity pattern in elevation.

7. A method for communicating millimeter-wave signals with an integrated millimeter-wave chip array reflector antenna system, the method comprising:

generating an incident antenna beam with a chip-array antenna comprising an array of antenna elements;

scanning the incident antenna beam over a surface of a millimeter-wave reflector;

shaping and reflecting the incident antenna beam with the millimeter-wave reflector to provide a steerable antenna beam over a plurality of beam-scanning angles for communicating with one or more user devices; and controlling an amplitude and phase of signals transmitted by the antenna elements to scan the incident antenna beam over the surface of the reflector, wherein millimeter-wave refractive material fills a spacing between the millimeter-wave reflector and the chip-array antenna, wherein the array of antenna elements is fabricated on either a ceramic substrate or a resistive poly-silicon dielectric substrate and the control elements are fabricated on a semiconductor die, and wherein the semiconductor die is integrated with either the ceramic or the poly-silicon dielectric substrate.

8. The method of claim 7 wherein the surface is defined by a substantially circular arc in a first plane and a substantially parabolic arc in a second plane to provide the steerable antenna beam having a diverging directivity pattern in azimuth and a substantially non-diverging directivity pattern in elevation.

9. The method of claim 8 wherein the reflector is non-symmetrical with respect to the substantially parabolic arc, and wherein a vertex of the substantially parabolic arc is located off of the surface of the reflector.

10. The method of claim 8 wherein the chip-array antenna is located at or near a focus of the substantially parabolic arc, the substantially parabolic arc being a generatrix of the surface, and wherein a location of the chip-array antenna with respect to the focus of the substantially parabolic arc is selected to reduce sidelobes of the steerable antenna beam.

11. The method of claim 7 wherein the surface is defined by a substantially circular arc in a first plane to provide the steerable antenna beam having a diverging directivity pattern in azimuth, and wherein the millimeter-wave reflector is further defined in a second plane to provide the steerable antenna beam having a substantially secant-squared directivity pattern in elevation.

12. The method of claim 7 wherein the surface is defined by a substantially circular arc in a first plane and an elliptical arc in a second plane to provide the steerable antenna beam having a diverging directivity pattern in azimuth and a substantially non-diverging directivity pattern in elevation.

13. An integrated millimeter-wave chip-array reflector antenna system comprising:

a millimeter-wave reflector to shape and reflect an incident antenna beam;

a chip-array antenna comprising an array of antenna elements to generate and direct the incident antenna beam at the reflector to provide a reflected antenna beam;

control elements to control an amplitude and phase of signals transmitted by the antenna elements to scan the incident antenna beam over the surface of the reflector; and millimeter-wave refractive material to fill a spacing between the millimeter-wave reflector and the chip-array antenna, wherein the array of antenna elements is fabricated on either a ceramic substrate or a resistive poly-silicon dielectric substrate and the control elements are fabricated on a semiconductor die, and wherein the semiconductor die is integrated with either the ceramic or the poly-silicon dielectric substrate.

14. The millimeter-wave chip-array reflector antenna system of claim 13 wherein the surface is defined by a substantially circular arc in a first plane and a substantially parabolic arc in a second plane to provide the reflected antenna beam having a diverging directivity pattern in azimuth and a substantially non-diverging directivity pattern in elevation.

15. The millimeter-wave chip-array reflector antenna system of claim 14 wherein the reflector is non-symmetrical with respect to the substantially parabolic arc, and wherein a vertex of the substantially parabolic arc is located off of the surface of the reflector.

16. The millimeter-wave chip-array reflector antenna system of claim 14 wherein the control elements to control the amplitude and phase of signals transmitted by the antenna elements to scan the incident antenna beam over the surface of the reflector to provide a steerable antenna beam over a plurality of beam-scanning angles.

17. The millimeter-wave chip-array reflector antenna system of claim 13 wherein the millimeter-wave communication station is an access point for a wireless local area network (WLAN) using orthogonal frequency division multiplexed (OFDM) signals comprising a plurality of subcarriers at millimeter-wave frequencies.

18. The millimeter-wave chip-array reflector antenna system of claim 13 wherein the millimeter-wave communication station is a base station for a broadband wireless access (BWA) network and uses orthogonal frequency division multiple access (OFDMA), wherein the millimeter-wave signals comprise a plurality of subcarriers at millimeter-wave frequencies.

* * * * *

UNITED STATES PATENT AND TRADEMARK OFFICE

CERTIFICATE OF CORRECTION

PATENT NO. : 8,395,558 B2
APPLICATION NO. : 12/301669
DATED : March 12, 2013
INVENTOR(S) : Alamouti et al.

It is certified that error appears in the above-identified patent and that said Letters Patent is hereby corrected as shown below:

On the title page, in column 1, under item "(75) Inventors", line 8, before "Novgorod", insert --Nizhny,--, therefor On the title page, item (56)

In column 2, under "Other Publications", line 2, delete "Personal," and insert --Personal--, therefor On page 2, in column 2, under "Other Publications", line 4, delete "03.," and insert --03,--, therefor On page 2, in column 2, under "Other Publications", line 7, delete "Proceedings," and insert --Proceedings--, therefor On page 2, in column 2, under "Other Publications", line 7, delete "2003.," and insert --2003,--, therefor On page 2, in column 2, under "Other Publications", line 17, after "Application", insert --Serial--, therefor On page 2, in column 2, under "Other Publications", line 29, after "Application", insert --Serial--, therefor On page 2, in column 2, under "Other Publications", line 31, after "Application", insert --Serial--, therefor On page 2, in column 2, under "Other Publications", line 33, after "Application", insert --Serial--, therefor On page 2, in column 2, under "Other Publications", line 35, after "Application", insert --Serial--, therefor Signed and Sealed this
Ninth Day of December, 2014

Michelle K. Lee

Michelle K. Lee
*Deputy Director of the United States Patent and Trademark Office*

On page 2, in column 2, under “Other Publications”, line 48, delete “pg.” and insert --pgs.--, therefor On page 3, in column 1, under “Other Publications”, line 36, delete “mailed” and insert --filed--, therefor On page 3, in column 2, under “Other Publications”, line 8, delete “W” and insert --w--, therefor On page 3, in column 2, under “Other Publications”, line 12, delete “dated” and insert --mailed--, therefor On page 3, in column 2, under “Other Publications”, line 13, after “Application”, insert --Serial--, therefor On page 3, in column 2, under “Other Publications”, line 21, delete “dated” and insert --mailed--, therefor On page 3, in column 2, under “Other Publications”, line 22, delete “11/452,710 ,” and insert --11/452,710,--, therefor On page 3, in column 2, under “Other Publications”, line 25, delete “16pgs.” and insert --16 pgs.--, therefor On page 3, in column 2, under “Other Publications”, line 45, delete “w/ English” and insert --w/English--, therefor In the Claims In column 13, line 4, in Claim 1, delete “angle;” and insert --angle,--, therefor In column 14, line 67, in Claim 16, after “elements”, delete “to”, therefor

UNITED STATES PATENT AND TRADEMARK OFFICE

CERTIFICATE OF CORRECTION

PATENT NO. : 8,395,558 B2
APPLICATION NO. : 12/301669
DATED : March 12, 2013
INVENTOR(S) : Alamouti et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 870 days.

Signed and Sealed this
First Day of September, 2015

Michelle K. Lee

Michelle K. Lee
*Director of the United States Patent and Trademark Office*